United States Patent [19]

Call

[11] Patent Number: 4,573,268

[45] Date of Patent: Mar. 4, 1986

[54] FOLDING FILLET KNIFE WITH BLADE LATCHING MEANS

[75] Inventor: Daniel D. Call, Athens, Wis.

[73] Assignee: Oy Fiskars AB, Helsinki, Finland

[21] Appl. No.: 743,594

[22] Filed: Jun. 11, 1985

Related U.S. Application Data

[63] Continuation of Ser. No. 464,678, Feb. 7, 1983, abandoned.

[51] Int. Cl.[4] ..... B26B 1/04

[52] U.S. Cl. ..... 30/161; 30/160

[58] Field of Search ..... 30/161, 160, 157; 7/106; 17/68

[56] References Cited

U.S. PATENT DOCUMENTS

| | | | |
|---|---|---|---|
| 631,547 | 8/1899 | Miller | 30/161 |
| 1,030,058 | 6/1912 | Doles | 30/161 |
| 1,647,405 | 11/1927 | Giesen | 30/160 |
| 2,263,415 | 11/1941 | Berg et al. | 30/160 |
| 4,040,181 | 8/1977 | Johnson | 30/161 |
| 4,268,960 | 5/1981 | Reinschreiber | 30/161 |
| 4,274,200 | 6/1981 | Coder | 30/161 |
| 4,451,982 | 6/1984 | Collins | 30/161 |

*Primary Examiner*—Frank T. Yost

*Attorney, Agent, or Firm*—James E. Nilles; Thomas F. Kirby

[57] ABSTRACT

A folding fillet knife comprises a molded two-piece plastic or metal handle, a metal blade pivotally connected to the handle and pivotable between open and closed positions, and a latching member slidably mounted on the handle. The latching member is spring biased into a latching position wherein it engages the base end of the blade and either releasably secures the blade in closed position or positively locks the blade in open position. The latching member is slidably movable to an unlatching position either automatically (as the blade opens) to enable the blade to be pivoted from closed to open position, or manually to allow the blade to be pivoted from open to closed position.

4 Claims, 8 Drawing Figures

FOLDING FILLET KNIFE WITH BLADE LATCHING MEANS

This is a continuation application based on U.S. Ser. No. 464,678, filed Feb. 7, 1983, and now abandoned.

BACKGROUND OF THE INVENTION

1. Field of Use

This invention relates generally to a folding knife, such as a fillet knife, which has a handle and a blade pivotally connected thereto and swingable between open and closed positions. In particular, it relates to a knife of the aforesaid character having improved blade latching means for releasably securing the blade in closed position and for releasably but positively locking the blade in open position.

2. Description of the Prior Art

Folding knives suitable for carrying in one's pocket or in a sheath and embodying blade latching means of various types are well-known and the following U.S. patents illustrate the state of the art: Berglund U.S. Pat. No. 598,896; Lake U.S. Pat. No. 3,783,509; Giesen U.S. Pat. No. 1,647,405; Miori U.S. Pat. No. 3,868,774; Waiwat U.S. Pat. No. 1,687,958; Berg et al. U.S. Pat. No. 2,263,415; Henry U.S. Pat. No. 4,170,061; Pantalek U.S. Pat. No. 1,353,490; Bobek U.S. Pat. No. 1,454,665; and Coder U.S. Pat. No. 4,274,200. In some prior art knives, the blade is lockable in closed position, or in open position, or in both positions, and the blade latching means must be manually manipulated to effect unlocking. Some of the prior art knives require blade latching means which are peculiar to the particular construction of the knives in which they are employed and are necessarily complex and employ numerous component parts. The prior art knife handles are usually fabricated of relatively heavy, expensive and numerous metal components.

SUMMARY OF THE PRESENT INVENTION

In accordance with the present invention there is provided an improved folding knife which is especially well-adapted for use as a fillet knife by fishermen and other sportsmen and which employs improved latching means well-suited thereto. The knife comprises a lightweight rustproof plastic handle, a stainless steel metal blade and rustproof components in the blade attachment and blade latching means. The improved latching means operates to resist accidental or unintentional movement of the blade from its closed or folded position within the handle and further operates to positively maintain the blade in open or unfolded position and prevent its movement to closed position unless the latching means are manually manipulated.

A folding knife in accordance with the invention comprises a handle, preferably fabricated of two mating molded plastic components and having cushion-type handle grips; a metal knife blade including a base end or tang; means for pivotably connecting the base end of the knife blade to one end of the handle to enable the knife blade to be swung between open and closed positions; and blade latching means for releasably securing the knife blade in closed position and for releasably but positively locking the blade in open position. The blade latching means comprises a latch member on the handle which is shiftably movable between latching and unlatching positions; biasing means for biasing the latch member into latching position; and means for manually shifting the latch nember from latching to unlatching position against the bias of the biasing means. When the blade is in closed position, the latch member is biased in latching position and is engaged with one portion of the base end of the blade to inhibit but not prevent the blade from being swung to open position. When the blade is being swung from closed to open position, the latch member is shifted by the base end of the blade from latching to unlatching position.

When the blade is in open position, the latch member is shifted by said biasing means from unlatching to latching position into engagement with another portion of the base end of the blade to positively prevent swinging of the blade from open to closed position. The latch member is manually shiftable from latching to unlatching position and out of engagement with the other portion of the base end of the blade to enable the blade to be swung from open to closed position.

The blade latching means includes the aforementioned latch member which is slidably mounted on and within the handle and also includes a biasing spring between the latch member and a portion of the handle. The spring serves as the biasing means to bias the latch member in one direction into its latching position. The latch member is provided with projections which extend from apertures formed on opposite sides of the handle and serve as the means for manually shifting the latch member in a direction opposite to said one direction. The latch member is provided with a latch slot which overlies the base end or tang of the knife blade, which tang comprises a pair of oppositely disposed side edges and an end edge therebetween. When the blade is closed, one side edge of the tang bears against the underside of the latch member, but a corner of the tang where said one side edge and the end edge meet lies below and is able to enter the latch slot. Thus, during blade opening the said corner of the tang enters the latch slot to force the latch member to open position. When the blade is open, the other or opposite side edge of the tang bears against the underside of the latch. However, the blade cannot be swung closed until the latch member is manually shifted so that another corner of the tang where said other side edge and the end edge meet is able to enter the latch slot.

A folding fillet knife in accordance with the present invention offers numerous advantages over the prior art. For example, the materials of which it is made renders it rustproof and waterproof. The handle has washable grips which afford a firm gripping surface. The blade latching means inhibit accidental blade opening but allow intentional blade opening without separate nanual manipulation of the latching means. However, the blade latching means prevent unintentional closure of the blade and require deliberate manual manipulation of the latching means. The handle is constructed of molded plastic components which are strong and easy and economical to fabricate and assembly. The latching means are simple in design and construction, economical to fabricate and reliable in use. Other objects and advantages of the invention will hereinafter appear.

DRAWINGS

DESCRIPTION OF A PREFERRED EMBODIMENT

Figure 1:
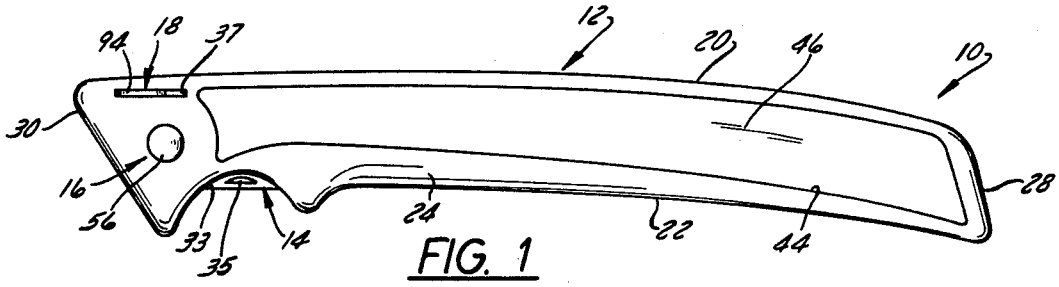
FIG. 1 is a side elevation view of a folding fillet knife in accordance with the present invention and showing it in folded condition.
Figure 2:
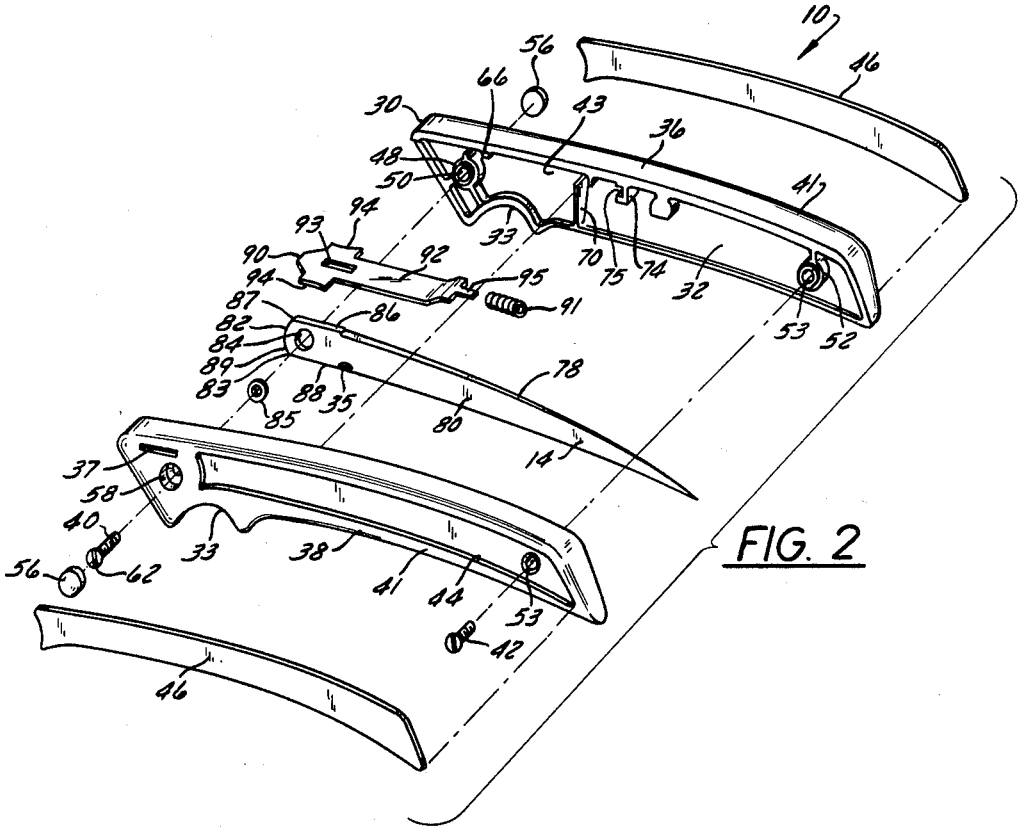
FIG. 2 is a reduced scale exploded view of the knife shown in FIG. 1 in folded condition.
Figures 3, 4, 5, 6, 7, 8:
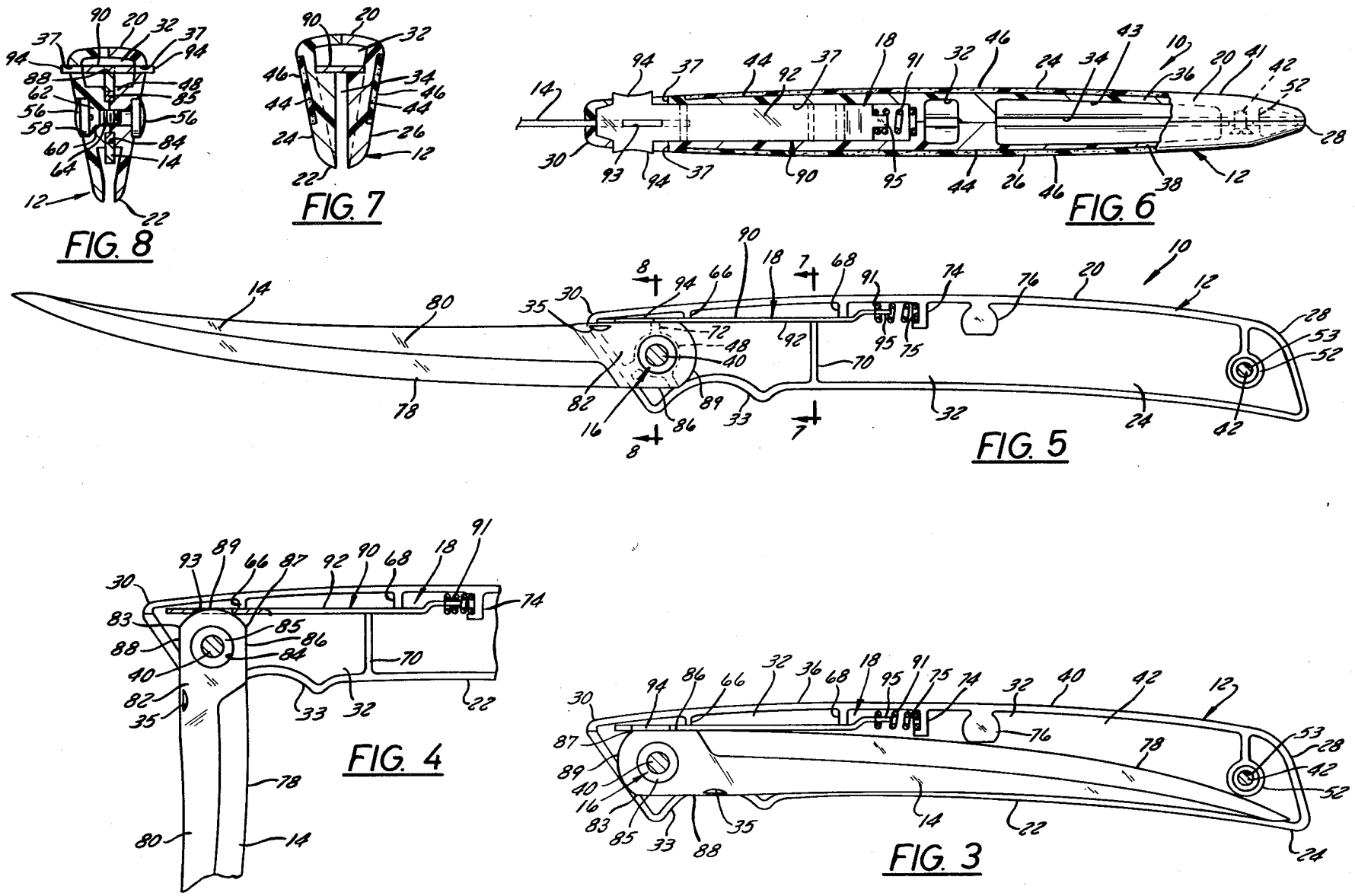
FIG. 3 is a view, with portions deleted and partly in cross-section, of the knife shown in FIG. 1 in folded condition.
FIG. 4 is a view similar to FIG. 3 but showing only a portion of the knife and with certain components disposed between folded and unfolded condition.
FIG. 5 is a view similar to FIGS. 3 and 4 but showing the knife in fully unfolded condition.
FIG. 6 is an enlarged cross-section view of the knife.
FIG. 7 is a cross-section view taken on line 7—7 of FIG. 5.
FIG. 8 is a cross-section view taken on line 8—8 of FIG. 5.

Referring to FIGS. 1, 2 and 3, the numeral 10 designates a folding fillet knife in accordance with the invention which is shown in folded condition in FIGS. 1, 2 and 3. Knife 10 comprises a handle 12, a blade 14, means 16 for pivotally connecting the blade to the handle so that the blade can be pivoted or swung between closed position (shown in FIGS. 1, 2 and 3) and open position (shown in FIGS. 5 and 6), and blade latching means 18 for releasably securing the knife blade in closed position and for releasably but positively locking the blade in open position.

As FIGS. 1, 4 and 7 show, handle 12 generally comprises an upper side 20, a lower side 22, opposite lateral sides 24 and 26, a rear end 28, a forward end 30, and a recess 32 extending inwardly into the handle from lower side 22 and forward end 30. Recess 32 houses certain components hereinafter described and also serves as or includes a blade-receiving slot 34. The lower side 22 of handle 12 comprises an inwardly extending concave finger recess 33 which also affords access to the blade 14 to enable it to be grasped and swung to open position. Blade 14 has a small indentation 35 to facilitate gripping by the user's fingernail.

As FIGS. 2, 6, 7 and 8 show, handle 12 comprises two handle members 36 and 38 which are substantially identical but are mirror images of each other and which are secured together in mating relationship by a pair of screws 40 and 42. The handle members 36 and 38 are preferably fabricated by casting or molding from rigid plastic (although they could be formed of metal or by machining).

Each handle member 36, 38 includes an outer surface 41 and an inner surface 43 which is provided with a plurality of integrally formed structures, hereinafter identified, which serve various supporting functions, as well as to strengthen and rigidify the handle member 36, 38 and the handle 12 of which it is a part.

The outer surface 41 of each handle member 36, 38 is provided with a recess 44 extending substantially the length thereof in which a piece of inlay material 46 is secured, as by an adhesive (not shown). The piece of inlay material 46 preferably takes the form of a strip of a compressible sponge-like washable plastic material which serves to enhance the grip of the user on the knife handle 12, especially if it is wetted with water or slippery animal body fluids.

Each handle member 36, 38 is provided with a slot 37 which extends therethrough and is adapted to accommodate portions of a latch member 90 hereinafter described.

The structures formed on the inner surface 43 of each handle member 36, 38 comprise a boss 48 having a hole 50 therethrough for accommodating screw 40; and a boss 52 having a hole 53 therethrough for accommodating screw 42. As FIG. 8 best shows, hole 50 in handle member 38 includes an outer portion 58 for accommodating an end cap 56, a conical middle portion 60 of smaller diameter for receiving the head 62 of screw 40, and an inner portion 64 of still smaller diameter for receiving the shank of the rivet 40. Hole 50 in handle member 36 is similarly configured. The structures on inner surface 43 further include two spaced apart upper latch guides 66 and 68 and a lower latch guide 70 between which a latch member 90, hereinafter described, is slidably mounted. A projection on boss 52 also serves as another lower latch guide 72. The structures on inner surface 43 also include a generally L-shaped spring support member 74 defining a recess 75 and a blade-stop member 76 which also serves as a support to prevent inward movement of blade 14 relative to handle 12 while the knife 10 is being manipulated by a user. The aforementioned boss 52 also serves as a blade stop.

Knife blade 14 of knife 10 is fabricated of metal and comprises a cutting edge 78, a back 80 and a base end or tang 82. Tang 82 is provided with a hole 84 for receiving a bushing 85, preferably made of a material such as brass or bronze, through which the shank of screw 40 extends. Screw 40, besides serving to aid in securing the two handle members 36 and 38 together, is part of the means 16 for pivotally connecting blade 14 to handle 12. Tang 82 is provided with oppositely disposed flat side edges 86 and 88 on the cutting edge side and the back side, respectively, of blade 14. Tang 82 also includes a curved or convex end edge 89. The edge 88 forms part of the means 18 for positively locking the blade 14 in open position. The edge 86 forms part of the means for releasably securing or maintaining the blade 14 in closed position. The end edge 89 and side edge 86 intersect to define a corner or projection 87 which forms part of a means for automatically shifting latch member 90 to unlatching position and thus enabling the blade 14 to be swung from closed to open position. The end edge 89 and side edge 88 intersect to define a second corner or projection 83.

As FIGS. 2 and 3 through 8 show, the blade latching means 18 includes the slidably movable latch member 90, hereinbefore referred to, and biasing means in the form of a helical compression spring 91, preferably made of stainless steel. Latch member 90, which is preferably fabricated of a rigid piece of punched and stamped sheet metal such as stainless steel, generally comprises a flat, elongated intermediate portion 92 having a tang-receiving slot or recess 93 near its forward end and having a pair of oppositely disposed laterally extending finger grips 94 near the forward end. Latch member 90 is slidably mounted between the lower latch guides 70, 72 and the upper latch guides 66, 68. Forward travel of latch member 90 is limited by engagement of its forward end with inner surface 43. The grips 94 extend outwardly through the slots 37 in the handle members 36 and 38 and are grippable by the thumb and forefinger of the knife user to shift the latch member 90 toward the rear end 28 of knife handle 14 into latch release or unlatching position against the bias of spring 91. Intermediate portion 92 of latch member 90 is provided at its rear end with an upwardly offset spring-engaging projection 95 which extends into one open end of coiled spring 91. The opposite end of spring 91 extends into spring-receiving recess 75.

The knife 10 operates as follows.

Assume initially that knife 10 is in the closed position shown in FIGS. 1, 2 and 3. In this position, blade 14 is completely disposed within blade-receiving slot 34, except for the small blade portion visible and accessible in finger recess 33. Furthermore, spring 91 acts to bias and maintain latch member 90 in its forward or latching position wherein the underside of intermediate portion 92 and a portion of slot 93 therein overlie the edge 86 of blade tang 82. The cutting edge 78 of blade 14 is stopped against the blade stop member 76 and boss 48 but is not harmed thereby because elements 76 and 48 are made of plastic. When blade 14 is closed, the side edge 86 of tang 82 bears against the underside of latch member 90, but the corner 86 of tang 82 where side edge 86 and the end edge 89 meet lies below and is able to enter the latch slot 93.

To move the blade 14 from closed position to the open position shown in FIGS. 5 and 6, it must first transition through the intermediate position shown in FIGS. 4. Thus, during blade opening (compare FIGS. 3 and 4) the corner 87 of tang 82 enters the latch slot 93 to force the latch member 90 to unlatching position (rightward with respect to FIG. 3). When the blade 14 is open (see FIG. 5), the other or opposite side edge 88 of tang 82 bears against the underside of latch member 90. However, the blade 14 cannot be swung from open to closed position until the latch member 90 is manually shifted rearward to unlatching position so that the other corner 83 of tang 82, where the side edge 88 and the end edge 89 meet, is able to enter the latch slot 93.

I claim:

1. A folding knife comprising:

a handle;

a blade including a base end;

means for pivotably connecting said base end of said blade to one end of said handle to enable said blade to be swung between open and closed positions; and blade latching means for releasably securing said blade in closed position and for releasably and positively locking said blade in open position, said blade latching means comprising:

a latch member on said handle which is shiftably movable lengthwise relative to said handle between latching and unlatching positions and having a slot cooperable with and for accommodating portions of said base end of said knife blade;

biasing means for moving said latch means lengthwise relative to said handle and for biasing said latch member into latching position when said blade is in open position;

said slot on said latch member being engageable with said base end of said knife blade to effect lengthwise shifting of said latch member from latching to unlatching position in response to movement of said knife blade; and means on said latch member extending from said handle for manually shifting said latch member from latching to unlatching position.

2. A folding knife according to claim 1 wherein, when said blade is in closed position, said latch member is biased in latching position and engaged with one portion of said base end of said blade;

wherein, when said blade is being swung from closed to open position, said latch member is shiftable by said base end of said blade engaging said slot from latching or unlatching position, wherein, when said blade is in open position, said latch member is shiftable by said biasing means from unlatching to latching position into engagement with another portion of said base end of said blade to prevent swinging of said blade from open to closed position; and wherein, when said blade is in open position, said latch member is manually shiftable from latching to unlatching position and out of engagement with said other portion of said base end of said blade to enable said blade to be swung manually from open to closed position.

3. A folding knife comprising:

a handle having a recess therein and at least one aperture;

a blade including a base end;

said base end including opposite edges and an end edge therebetween defining two corners on said base end;

means for pivotably connecting said base end of said blade to said handle whereby said blade is pivotably movable between a closed position within said recess and an open position extending from an end of said handle; and blade latching means for releasably securing said blade in closed position and for releasably and positively locking said blade in open position;

said blade latching means comprising a latch member mounted on said handle in said recess and shiftably movable between latching and unlatching positions, said latch member having a slot therein and gripping means thereon extending through said aperture in said handle;

said blade latching means further comprising biasing means in said handle recess between said latch member and said handle for biasing said latch member into said latching position;

said blade when in either closed or open position having an opposite edge of said base end engaged with said latch member, said blade when in closed position having one of said corners of said base end in position to enter said slot in said latch member to effect shifting movement of said latch member from latching to unlatching position.

4. A folding knife according to claim 3 wherein said handle comprises a pair of mating plastic or metal handle members cooperating to define said recess in said handle and means for securing said handle members together, and wherein said handle members are provided on the interior surfaces thereof with structures for slidably supporting said latch member and for engagement with said biasing means.

* * * * *